United States Patent [19]

Heubl

[11] 4,387,826

[45] Jun. 14, 1983

[54] CLOSURE FOR CANS PROVIDED WITH BEADED EDGE

[76] Inventor: Walter Heubl, Bergstr. 7, 8901 Aystetten, Fed. Rep. of Germany

[21] Appl. No.: 288,700

[22] Filed: Jul. 31, 1981

[30] Foreign Application Priority Data

Aug. 5, 1980 [DE] Fed. Rep. of Germany ... 8020985[U]
Jul. 21, 1981 [EP] European Pat. Off. ..... 81105748.8

[51] Int. Cl.[3] ..... B65D 45/00

[52] U.S. Cl. ..... 220/243; 220/314; 220/85 SP; 222/570

[58] Field of Search ..... 220/314, 306, 323, 85 SP, 220/243; 215/287, 280; 222/566, 570

[56] References Cited

U.S. PATENT DOCUMENTS 3,680,732 8/1972 Dickie ..... 220/314
3,871,547 3/1975 Wharton ..... 220/287
3,913,779 10/1975 Blazer et al. ..... 220/314

*Primary Examiner*—George T. Hall
*Attorney, Agent, or Firm*—Karl F. Ross; Herbert Dubno

[57] ABSTRACT

A closure device for cans having a beaded edge and a cover with a wall part to be torn-off for formation of a pouring opening, the closure device being provided at two opposite ends of a base body with flanges directed toward each other, which grip under the beaded edge of the can. One of the flanges is elastically deflectable, the other flange is formed rigid, such that the closure device can be pressed onto the can from above like a snap-on-cap. A sealing ring is guided at the base body at the side disposed opposite to the pouring opening such that this sealing ring grips around the exit opening in a compressed state upon placing of the closure device onto the can, the sealing ring being disposed tightly at the cover of the can. Selected FIG. 4.

11 Claims, 11 Drawing Figures

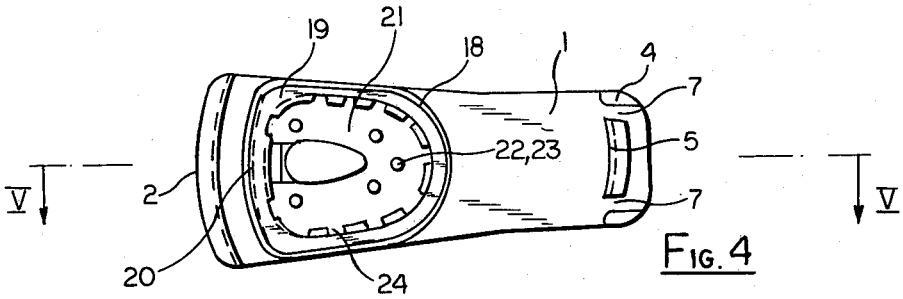
FIG. 4
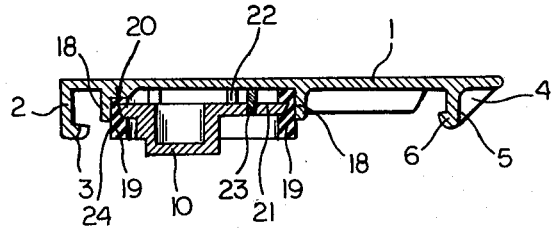
FIG. 5
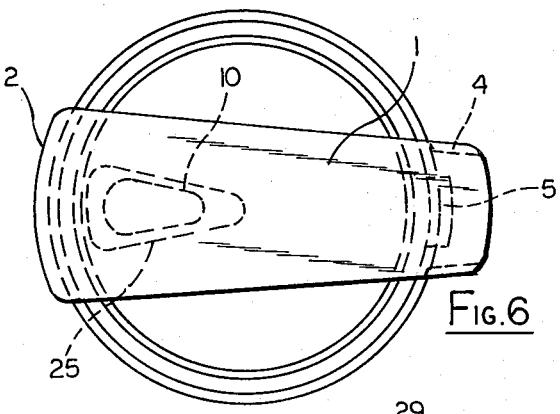
FIG. 6
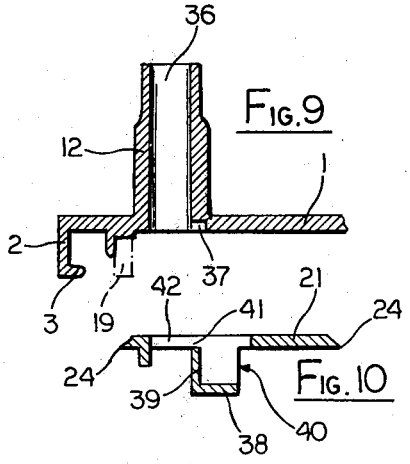
FIG. 9
FIG. 10
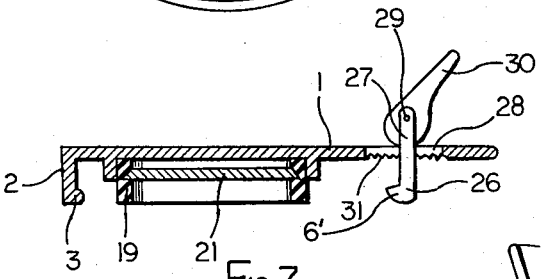
FIG. 7
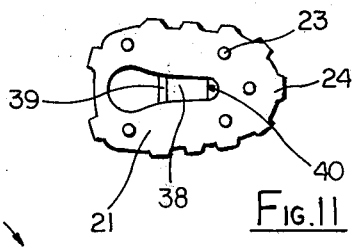
FIG. 11
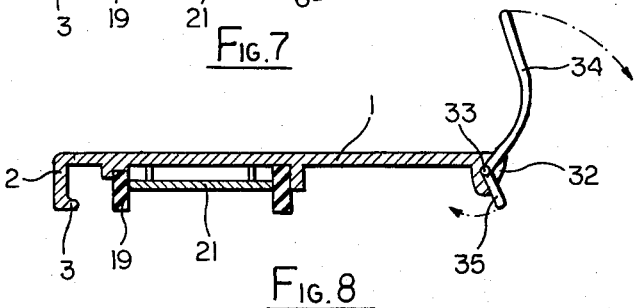
FIG. 8

CLOSURE FOR CANS PROVIDED WITH BEADED EDGE

FIELD OF THE INVENTION

The invention relates to a closure for cans provided with a beaded edge, where a preferably triangular pouring opening is present in the cover of the can to be formed by a wall part which is to be torn off, where the closure is provided with an edge web gripping under the beaded edge of the can as well as a seal surrounding the edge of the pouring opening.

BACKGROUND OF THE INVENTION

A closure with these features is taught in German Gebrauchsmuster DE-GBM No. 77 37 634, which in fact is also applicable for cans without tear-up closure. A metallic base body surrounded by a plastic handle grips with a nose behind the beaded edge of the can. At the base body there is provided a pouring nose with a sharp inclined edge, which upon pressing on the can cover cuts in an opening. Furthermore, a hook-shaped hole tool is attached to the base body formed as a pin, which penetrates also through the can cover and which thereby gets hooked such that the closure cannot be lifted up without effort.

Other known closures for cans with a tear-up closure in the cover are provided with a rotary nose with an inclined clamping face to be inserted through the pouring opening. This nose clamps against the inner face of the cover upon rotation and thereby presses a plate-shaped rubber body positioned on the outside of the cover against the edge of the pouring opening. However, it has been shown that with this provision a complete sealing of the can cannot be achieved, not to speak of the increased costs for the formation of a closure from several parts together with the required assembly.

OBJECT OF THE INVENTION

It is an object of the present invention to produce a can closure from a plastic body, which can be solidly connected to the can, which can be produced with simple means and which nevertheless assures a sufficient sealing of the can even upon increased internal pressure based on gas formation.

SUMMARY OF THE INVENTION

Starting from the initially mentioned closure device, the substance of the invention comprises that an edge web formed unitary with the plastic closure is provided with a curvature adapted to the diameter of the beaded edge of the can, and that opposite to the edge web there is disposed a further edge web on the plate forming the base body at a distance corresponding to the diameter of the can, which further edge web is formed by an elastically deflectable or spring wall section having a flange gripping under the beaded edge of the can.

By having the base body formed by a plate unitary with the edge webs, the base body shows a certain elasticity. The snap-on cap closure is pressable over the beaded edge of the can and will thus upon inner pressure from the can curve slightly upwardly, which will result in an even tighter clamping of the closure on the can. Based on this simple form, the novel closure can be produced inexpensively as an item of mass production. A particularly good sealing effect is achieved if the closure of the present invention is provided with a downwardly projecting skirt surrounding the opening in the can cover and a sealing ring disposed between the skirt and cover.

Another feature of the invention provides the advantage in that a particular configuration of a projection extending into the can allows the liquid contents of the can to be poured with a uniform stream without the need of a ventilating tube.

Since some cans exhibit certain differences in tolerances in the diameter of their beaded edge, other embodiments of the invention have adjustable tensioning elements which also provide the possibility to employ the same closure for cans of different sizes.

BRIEF DESCRIPTION OF THE DRAWING

The above and other objects, features and advantages of the invention will become more readily apparent from the following description, reference being made to the accompanying drawing in which:

FIG. 4 is a bottom view of a can closure according to another embodiment of the invention;

FIG. 5 is a longitudinal sectional view along line V—V of FIG. 4;

FIG. 6 is a plan view of the can closure in place on a can;

FIGS. 7 and 8 are side views of further embodiments of the invention showing can closures with adjustable settings;

FIGS. 9 and 10 are longitudinal sectional views through a pouring spout with a clamping cover, according to another embodiment of the invention; and FIG. 11 is a plan view of the clamping cover according to FIG. 10.

SPECIFIC DESCRIPTION

Figure 1:
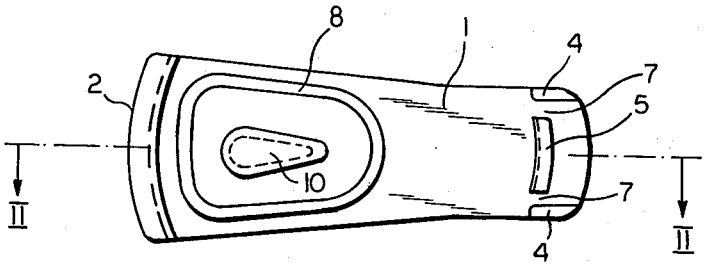
FIG. 1 is a bottom view of a can closure according to the invention.
Figure 2:
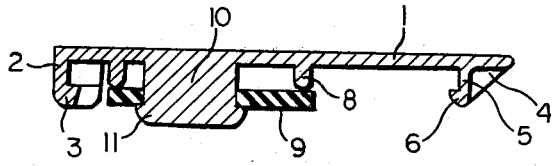
FIG. 2 is a longitudinal sectional view taken along line II—II of FIG. 1.

The closure device shown in the embodiment of the FIGS. 1 and 2 comprises a plate forming a base body 1 having a wall thickness such that this base body can be elastically deformed. A curved edge web 2 adapted to the diameter of the can or respectively its beaded edge or rim is disposed at the wider end of the base body and the curved edge web 2 grips with a flange 3 protruding inwardly under the beaded edge of the can. A further curved edge web 5 is disposed at the opposite narrower end of the base body at a distance corresponding to the can diameter, which comprises an elastically deflectable wall section 5 flanked by rigid formations 4. The spring wall section 5 is spaced from the rigid formations by cut-outs 7 as shown in the embodiments of FIGS. 1 and 2. The spring wall section 5 is also provided with a flange 6 protruding inwardly, which grips under the beaded edge of the can like a snap-on cap when the closure is placed from above onto the can.

Here, the closure device is designed for cans (see FIG. 6) where the cover comprises a tear-off closure, which after tearing off, leaves a triangular pouring opening 25. A pin 10 extends into this pouring opening of the can, which pin is attached to the base body 1. This pin is formed with an end protrusion 11 (mushroom like shape) engaging a sealing disc 9, for example made from rubber, which is disposed adjacent a closed skirt 8 of the base body 1, the cross-section of which can be wedge shaped. The sealing disc 9 is positioned with its free face on the top side of the can cover surrounding the edge of the pouring opening 25. The height of the edge webs 2, 5 or respectively the distance of the flanges 3, 6 from the base body 1 are dimensioned such that in the clamped on state the closed skirt 8 presses the sealing disc 9 solidly against the cover of the can.

The rigid formations 4 abut the outer surface of the beaded edge of the can in the clamped on state and thereby tension the opposite edge web 2 to such an extent that its protruding flange 3 grips securely under the beaded edge of the can. In this position also the protruding flange 6 of the springing wall section 5 is engaged under the beaded edge of the can. For this reason, the positions of the edge web 5 and formations 4 are such that on the one hand the tensioning between the rigid formations 4 and the web 2 is possible and nevertheless the springing wall section 5 can snap over the beaded edge of the can. Even a vapor pressure increase generated by heating inside of the can cannot result in an opening of the closure in this solidly tensioned position, since based on the bendability of the base body upon exertion of the internal pressure from the can a convex bulging occurs, which induces the edge webs 2 and 5 and formations 4 of the closure to press even tighter against the beaded edge.

Figure 3:
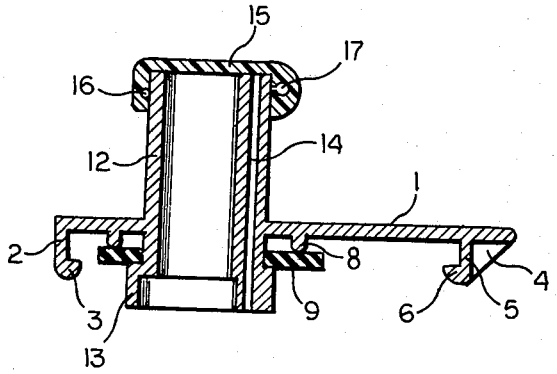
FIG. 3 is a longitudinal sectional view taken through a can closure similar to FIG. 2, but formed with a pouring spout.

The embodiment of FIG. 3 shows that a pouring spout 12 can be formed with the base body 1. Spout 12 has a protrusion 13 engaging the sealing disc 9, and which comprises an aeration tube 14, the spout and tube being covered tightly by a cap 15 in the closed position thereof. A bead 16 is provided at the open end of the pouring spout and a corresponding recess of the cap 15 snaps on the bead 16. In addition, a pivot joint 17 provides a connection of the cap 15 to the spout which cannot be easily severed.

The embodiment of FIGS. 4 and 5 is distinguished from the embodiment of the FIGS. 1 and 2 in the manner in how the seal is constructed and how the seal becomes effective. The base body 1 is provided with an egg-shaped closed guide skirt 18 extending around the bottom side of the base body 1 in the region of the can opening. A sealing ring 19 is guided and supported at the inner face of the guide skirt 18. The sealing ring 19 is formed as a hollow cylinder in its original shape where the wall thickness is less than the wall height. Based on its elasticity the circular sealing ring 19 assumes substantially the shape of the guide skirt 18 upon insertion. Therefore, the sealing ring 19 seals off the region of the can cover which surrounds the pouring opening 25 (see FIG. 6). It is desirable that the sealing be more compressed where the pouring opening 25 has its largest width. For this reason a protruding pressure shoulder 20 is provided at the bottom side of the base body 1, which pressure shoulder 20 acts on the corresponding region of the sealing ring 19. In this region the sealing ring is more compressed upon snap-on of the closure device on the can than in the remaining sealing ring region.

The support and the guiding of the sealing ring 19 is effected by way of a tensioning cover 21, which is provided with anumber of bore holes 23 into which correspondingly formed pins 22 of the base body 1 engage. The edge of the tensioning cover 21 is adapted to the form of the sealing ring 19 supported by the guide skirt 18. At places along the edge of cover 21, blade-shaped protrusions 24 extend outwardly. If the tensioning cover 21 with its bore holes 23 is pressed onto the pins 22, then the blade-shaped protrusions 24 grip into the inner wall region of the sealing ring 19 while they press the sealing ring 19 against the pressure shoulder 20 and the other somewhat recessed faces of the base body 1.

The embodiment of FIG. 6 represents a clearer illustration of how the closure device of the invention is seated on the can.

It can happen that cans of the same kind have different tolerances of diameter. There are also cans having certain deviations in their diameters. In order to be able to use the closure device of the invention in such cases, the invention provides, according to FIGS. 7 and 8, that at least one of the flanges gripping under the edge of the can be adjustable or slidably disposed on the base body 1 and thus an adapatation to the diameter of the can is achievable.

In the example of FIG. 7, the protruding flange 6 is disposed on a tensioning element 26, which grips through a slot 28 in the base body 1 and which is supported like a shoulder at the bottom side of the base body 1. A bearing 29 for tilting of an eccentric lever 30 is disposed at the web 27 protruding upwardly and the eccentric lever in turn acts on the upper surface of the base body 1. The tensioning element 26 can now be adjusted along the slot 28 such that the protruding hook 6′ grips around the beaded edge of the can. By tilting the eccentric lever 30 clockwise this position is then fixed. In order that no shifting motion can take place, the bottom side of the base body 1 has corrugations 31 and the shoulder like protrusion of the tensioning element 26 is also corrugated or formed in a similar way such that a mutual hooking and engaging can take place.

A bore hole 33 is provided at an edge strip 32 of the base body 1 in the example of FIG. 8 and the tensioning bracket 34, preferably made from spring steel wire or sheet metal, is rotatably supported in the bore hole 33. This tensioning bracket 34 is provided with shorter support arms 35, which turn toward the inside under the edge of the can upon rotation of the tensioning bracket 34 in a clockwise direction. By an appropriate formation of the angles of the arms of the tensioning bracket 34, it can be achieved that upon tilting, the tensioning bracket passes beyond a dead-center position and thus the support arms 35 are pressed stable against the bottom face of the can edge. If the tensioning bracket 34 is formed from spring steel wire, then it is sufficient if the support arms 35 are corresponding angled ends of this wire, which form with respect to each other an obtuse angle.

A variation to FIG. 3 is shown in the embodiment of FIGS. 9, 10 and 11, where it is the object to provide a pouring spout 12 with a single pouring channel 36 and to be able to dispense with the aeration tube 14 shown in FIG. 3. First, a wall cut-out 37 is provided at the pour position of the pouring channel 36 toward the side of the can and the functioning of the wall recess 37 can be understood in connection with the tensioning cover 21 shown in FIG. 10, which cover is pressed against the base body 1 in order to tightly clamp the sealing ring and to center the sealing ring 19 as was already mentioned in connection with FIGS. 4 and 5.

This tensioning cover 21 according to FIG. 10 comprises a protrusion 38 with a web 39 whereby the protrusion 38 forms the shape of a U with a bottom. A pouring opening 42 is disposed beyond the web 39 which is aligned with the pouring channel 36 of the pouring spout 12. Therefore, upon assembly, the web 39 is disposed at the wall cut-out 37. However, since the web 39 is provided with a wall cut-out 41, the inner area of the protrusion 38 is connected to the pouring channel 36 via the wall cut-out 41 or respectively the wall recess 37. Upon pouring therefore, the hollow volume not filled with liquid in the can can be connected via the opening 40 in the protrusion 38 and the wall cut-out 41 to the pouring channel 36. Since this pouring channel 36 is never completely filled with the liquid to be poured, a quiet exchange of internal air and external air results in the can. Surprisingly, it was found that such a construction results in a substantially better pouring of the liquid without damaging side effects, as is possible according to the state of the art.

I claim:

1. A closure device for cans having a beaded edge and a cover having a pouring opening formed by removal of a tear-off portion thereof, said closure device comprising:

a unitary synthetic resin elongated planar body having a length at least as great as the diameter of said can;

an edge web formed at one end of said body and having a curvature equal to the curvature of said beaded edge, said edge web being formed with an inwardly projecting flange for gripping the underside of said beaded edge;

a tensioning element formed at the other end of said body opposite said edge web and spaced therefrom at a distance substantially equal to the diameter of said beaded edge, said tensioning element having a formation adapted to engage the underside of said beaded edge and being deflectable for releasing same;

a flat extension formed on said body beyond said tensioning element and projecting over said edge of said can;

a pair of rigid formations on said body spaced to either side of said tension element and engaging the outer periphery of said beaded edge to cause tension between said rigid formations and said first mentioned edge web; and a seal mounted on said body and adapted to engage said cover around said opening.

2. The device defined in claim 1 wherein said tensioning element is a second edge web having a curvature equal to the curvature of said beaded edge and said formation is a second inwardly projecting flange formed on said second edge web, said second edge web being elastically deflectable.

3. The device defined in claim 1 or 2, further comprising a pouring spout formed on said body, said pouring spout having a pouring channel for communicating with said pouring opening and means also communicating with said pouring opening for allowing the exchange of air between the interior and exterior of said can, said pouring spout being further provided with means for closing said channel and said first mentioned means.

4. The device defined in claim 1 or 2, further comprising a projecting wall formed on said body in a substantially oval outline surrounding said pouring opening and said seal is a ring supported at said wall.

5. The device defined in claim 4 wherein said pouring opening is substantially triangular and said ring is supported at the inner face of said wall and said wall is further formed with a shoulder disposed between said ring and said body along the base side of said opening for imparting increased pressure to said ring in that region.

6. The device defined in claim 4, further comprising a tensioning cover connectable to said body and disposed within said ring engaging same to clamp said ring against said wall.

7. The device defined in claim 6 wherein said tensioning cover is formed with a plurality of blade-shaped protrusions along the periphery thereof, said protrusions engaging said

8. The device defined in claim 3 wherein said first mentioned means includes a pocket connectable to said body and extending into the interior of said can and lying along a generatrix of said pouring channel, said pocket having a first opening facing away from said channel in said can and a second opening smaller than said first opening communicating with said channel.

9. The device defined in claim 1 wherein said tensioning element is radially displaceable on said body and said formation is an inwardly projecting hook.

10. The device defined in claim 9, further comprising means on said tensioning element for camming said hook against the underside of said beaded edge, and a plurality of corrugations formed on said body and coacting with said tensioning element for maintaining same in a radial position on said body.

11. The device defined in claim 1 wherein said tensioning element is a lever pivotally mounted on said body and said formation is at least one short arm of said lever adapted to engage the underside of said beaded edge when a long arm of said lever is tilted past a dead-center point formed by said pivot.

* * * * *